United States Patent [19]

McManus

[11] 4,134,409

[45] Jan. 16, 1979

[54] SMOKING APPARATUS

[75] Inventor: Joseph H. McManus, Katy, Tex.

[73] Assignee: Marymac Industries, Inc., Katy, Tex.

[21] Appl. No.: 734,806

[22] Filed: Oct. 22, 1976

[51] Int. Cl.[2] ..... A24F 1/14; A24F 1/30

[52] U.S. Cl. ..... 131/173; 220/DIG. 19

[58] Field of Search ..... 131/173, 178, 225, 170; 220/DIG. 19

[56] References Cited

U.S. PATENT DOCUMENTS

| | | | |
|---|---|---|---|
| 1,579,703 | 4/1926 | Grant | 131/173 |
| 2,530,253 | 11/1950 | Maged et al. | 220/DIG. 19 |
| 3,442,377 | 5/1969 | Angelus | 220/DIG. 19 |

FOREIGN PATENT DOCUMENTS

| | | | |
|---|---|---|---|
| 1461573 | 12/1966 | France | 131/173 |

OTHER PUBLICATIONS

Science and Invention, Jul. 1927, p. 246.

*Primary Examiner*—Stephen C. Pellegrino
*Attorney, Agent, or Firm*—Browning, Bushman & Zamecki

[57] ABSTRACT

A smoking apparatus for use with a disposable can containing a filtering medium such as water, the apparatus including a flexible stopper member for sealingly engaging the peripheral edges of a generally keyhole shaped opening in the top of the can, the stopper having first and second passageways therethrough, a first tubular member extending into one of the passageways, a second tubular member extending through the other passageway, one end of the second tubular member extending into the can for a distance sufficient to extend into the filtering medium, the other member extending exteriorly of the container and being attached to a receptacle or bowl for holding smoking material.

2 Claims, 2 Drawing Figures

SMOKING APPARATUS

BACKGROUND OF THE INVENTION

The present invention relates to a smoking apparatus and, more particularly, to a smoke filtering apparatus in which the smoke from the tobacco passes through a filtering medium prior to being drawn into the smoker's mouth.

Waterpipes and the like in which smoke from the tobacco or other such smokable material is drawn through a liquid filtering medium such as water prior to entering the smoker's mouth have been used for many years. Examples of such smoking devices are shown in U.S. Pat. Nos. 44,414, 848,424 and 1,579,703.

Most prior art smoke filtering devices such as those shown in the aforementioned patents either employ containers which are specifically made for the filtering apparatus and which contain the filtering medium or utilize glass jars and other glass vessels as the container for the filtering medium. Such specially designed containers are generally difficult to clean and, in addition, make the apparatus more expensive to manufacture. Glass jars, glasses, etc. while they are cheaper, easier to clean and readily available suffer from the disadvantage that they are susceptable to breakage and are generally heavier than metal containers thus making them more difficult to manipulate. Additionally, since most glass containers are transparent, the tars and oils which collect on the inside of the glass containers and in the filtering medium present a most unsavory sight and detract from the smoker's pleasure.

In recent years, the so called "pop-top" can has become quite popular as a container for beer, soft drinks, fruit and vegetable juices, etc. Even more recently the so called "press tab" can has come into existence. Pop-top or press tab cans generally have a keyhole shaped or rounded, triangular opening in the top which is sealed by a metal closure member. The metal closure member can be separated from the can leaving the keyhole shaped opening in the top of the can either by depressing the closure member inwardly of the can (press tab can) or by using a pull ring attached to the closure member (pop top can). Since most of the pop-top or press tab cans are made of aluminum, they are quite lightweight. Accordingly, a smoke filtering apparatus which could employ such a can as a container for the filtering medium would be most advantageous.

SUMMARY OF THE INVENTION

It is therefore an object of the present invention to provide an improved smoke filtering apparatus.

Another object of the present invention is to provide an improved smoke filtering apparatus of the type wherein the smoke is drawn through a filtering medium, usually a liquid, prior to entering the smoker's mouth.

An important object of the present invention is to provide a smoke filtering apparatus which employs readily available, disposable containers to hold the filtering medium.

The above and other objects of the present invention will become apparent from the description given herein, the drawings and the appended claims.

The present invention provides a smoke filtering apparatus which can be used with readily available containers such as pop-top or press tab cans having a keyhole shaped opening in the top thereof, the can containing a suitable amount of filtering medium such as water, glass beads, etc. The smoke filtering apparatus employs a generally flexible stopper member having a body portion of the same general configuration as the keyhole shaped opening and which sealingly engages the peripheral edges of the keyhole shaped opening. The stopper member is provided with first and second passageways extending therethrough. A first tubular member, which serves as a mouthpiece, extends into one of the passageways. A second tubular member extends through the other of the passageways, one end of the second tubular member extending downwardly into the container for a distance sufficient to extend into the filtering medium. The other end of the second tubular member extends exteriorly of the container and is attached to a receptacle or bowl which holds the tobacco. The tobacco bowl has a bore providing open communication between the second tubular member and the interior of the bowl and which permits smoke from the tobacco to pass through the second tubular member into the container and through the filtering medium.

DESCRIPTION OF THE PREFERRED EMBODIMENT

Figure 1:
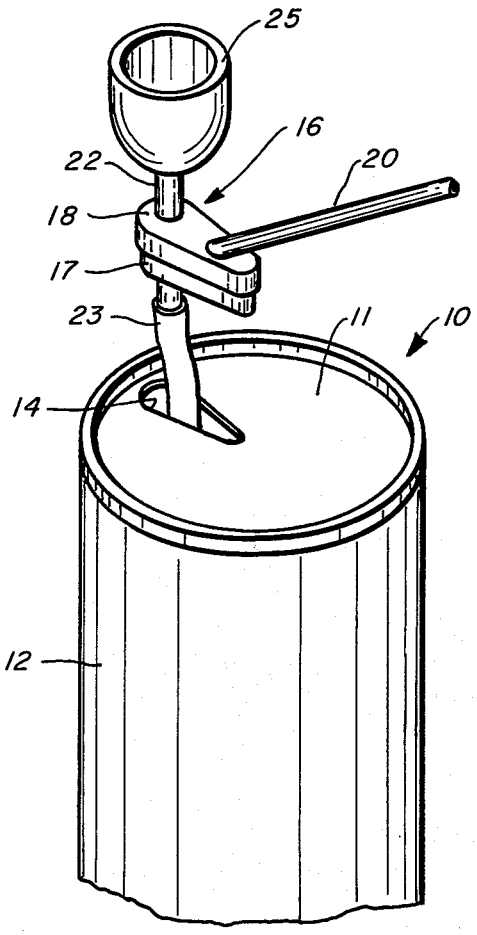
FIG. 1 is a perspective view of the apparatus of the present invention shown prior to being placed in the container holding the filtering medium.

Referring then to the figures, the container, shown generally as 10, comprises a can having a generally planar top wall 11, a side wall 12 and bottom wall 13, the container being generally cylindrically shaped. Top wall 11 has a generally keyhole shaped opening 14, the smaller, tapered end of the opening lying radially innermost of top wall 11. It will be appreciated that keyhole shaped opening 14 is formed by removal of or depression into the can of a closure member normally used to seal container 10 and well known to those skilled in the art.

Disposed in container 10 is a filtering medium 14 which most commonly will be some form of non-toxic cooling liquid such as water, but which can be a solid particulate material such as glass beads or the like which would serve to cool the smoke without removing the desired taste or aromas produced by the tobacco. It will be appreciated that non-toxic flavors and aromas can be added to the filtering medium to impart additional fragrance or taste to the smoke passing through filtering medium 15.

A flexible stopper member, shown generally as 16, includes a body portion 17 having a shape which generally conforms to the shape of keyhole shaped opening 14. Since stopper member 16 is flexible, when body portion 17 is disposed in opening 14, there is snug engagement between the peripheral edges of opening 14 and the outer periphery of body portion 17. Additionally, stopper member 16 is provided with a flange 18 which also has the same general configuration as keyhole opening 14 but is of a size somewhat larger. Thus, when stopper member 16 is placed in opening 14 and pressed down, the underside of flange 18 will engage top wall 11 of container 10 thereby preventing or, at least, restraining stopper 16 from moving downwardly through opening 14.

Figure 2:
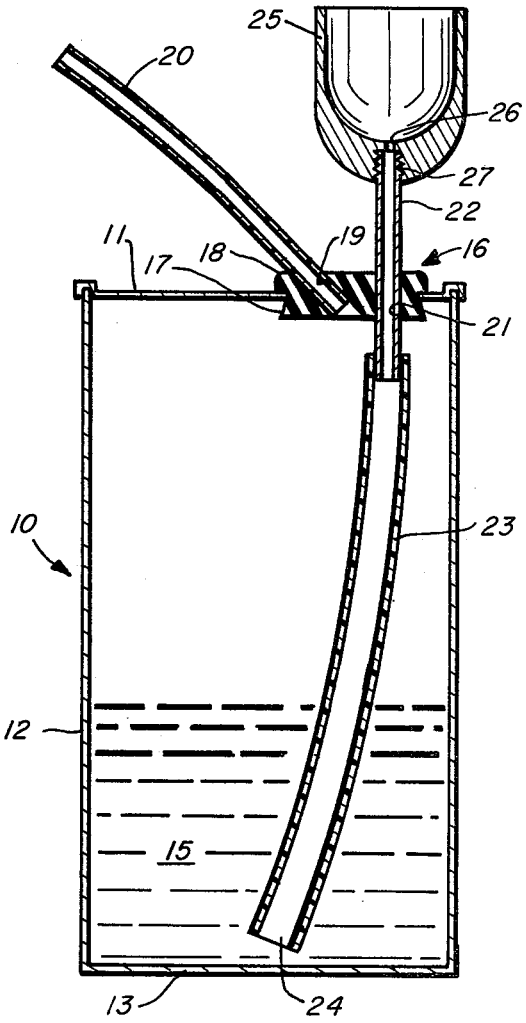
FIG. 2 is a cross sectional, elevational view showing the apparatus of the present invention disposed in the container containing the filtering medium.

Stopper 16 is also provided with a passageway 19 into which extends a tubular, flexible mouthpiece member 20. It should be observed that while tubular mouthpiece member 20 is shown as flexible, it can be rigid if desired. Stopper member 16 has a second passageway 21 through which extends a rigid tube 22. As can best be seen with reference to FIG. 2, passageway 21 has a long axis which is substantially perpendicular to the planar top wall 11 of container 10. Passageway 19, on the other hand, has a long axis which is disposed at an acute angle to top wall 11 of container 10. The mouths of passageways 19 and 21, exteriorly of container 10, lie a greater distance apart than the mouths of passageways 19 and 21 interiorly of container 10. The angling of passageway 19 in the manner shown permits tubular mouthpiece member 20 to be placed in the mouth of the smoker while container 10 is maintained in a substantially upright position. This provides a great advantage in that it eliminates the necessity for bending tubular mouthpiece 20 which, since it is generally of a flexible material, could cause crimping thereby restricting flow.

A segment of flexible tubing 23 is attached to rigid tube 22, the end 24 of tubing 23 being beneath the surface of the filtering medium 15. Attached to the other end of rigid tube 22 is tobacco receptacle 25. As best seen with reference to FIG. 2, tobacco receptacle 25 is generally bowl shaped and has a bore 26 disposed generally at the bottom thereof. Bore 26 is in open communication with a counterbore 27 which is of a larger diameter than bore 26 and which is threaded to receive the threaded end portion of rigid tube 22. This unique design of tobacco receptacle 25 provides several advantages. Since bore 26 is of a relatively small diameter compared to bore 27, there is less tendency for the smoking material in receptacle 25 to fall downwardly into container 10. By threading bore 27 and tube 22, receptacle 25 can be easily removed from tube 22 and the entire assembly thoroughly cleaned. It will be understood that bore 27 and tube 22 need not be threaded to provide removability of receptacle 25. Tube 22 can simply be left smooth and bore 27 sized so as to provide a friction fit over tube 22. It should also be noted that tube 22 and flexible tubing 23 could be of unitary construction, if desired.

The operation of the smoke filtering apparatus will be apparent. The tobacco is placed in receptacle 25 and lit. The smoker, having the free end of mouthpiece tubular member 20 in his mouth, then draws inwardly in the customary manner of smoking a pipe or the like. The smoke from the burning, smokable material in receptacle 25 is drawn through bores 26 and 27 into rigid tube 22, through tubing 23 and into filtering medium 15. The smoke bubbles upwardly through filtering medium 15 and is thus cooled. The cooled smoke which collects in the air space above filtering medium 15 is then drawn into mouthpiece member 20 and then into the mouth of the smoker.

It can be readily seen that the smoke filtering device of the present invention provides several significant advantages over previously known water pipes or the like. For one, container 10 is of a type readily available since such containers are virtually universally used to can beer, soft drinks and the like. Since container 10 is so readily available, it can be discarded after each use and therefore the necessity for cleaning of the container is eliminated. Additionally, since container 10 is of a lightweight metal such as aluminum, it can be easily handled and is not subject to breakage such as in the case of glass containers. Furthermore, since container 10 is metallic in nature and therefore not transparent, the unsightly build up of tars, oils and other substances from the burning tobacco is not visable to the smoker.

Although the invention has been described with a certain degree of particularity, with reference to certain specific embodiments, it is to be understood that the invention is in no sense limited thereby and its scope is to be determined by that of the appended claims.

I claim:

1. A smoke filtering apparatus for use with a container having a generally keyhole shaped opening in the top thereof and containing a filtering medium comprising:

a generally flexible stopper member having a body portion of the same general configuration as that of said keyhole shaped opening for disposing in and sealingly engaing the peripheral edges of said keyhole shaped opening, said stopper member having first and second passageways therethrough, and including a flange having the same general configuration of said keyhole shaped opening but being somewhat larger and engageable with the top of said container adjacent said keyhole shaped opening to restrain movement of said stopper into said keyhole shaped opening, a first flexible tubular member extending into said first passageway, a second tubular member having a rigid portion extending through said second passageway, and a flexible portion connected to said rigid portion and extending into said container for a distance sufficient for one end of said second tubular member on said flexible portion to extend into said filtering medium, the other end of said second tubular member on said rigid portion extending exteriorly of said container, and a generally bowl-shaped receptacle for holding smoking material, said receptacle being removably attached to said other end of said second tubular member and having a bore substantially at the bottom thereof providing open communication between the interior of said receptacle and the interior of said second tubular member, said bore being substantially circular when viewed in transverse cross section and having a smaller diameter portion opening interiorly of said receptacle and a larger diameter portion for receipt of said other end of said second tubular member.

2. The apparatus of claim 1 wherein said top of said container is substantially planar, the long axis of said second passageway being substantially perpendicular to said top, the long axis of said first passageway forming an acute angle with said top, the distance between the mouths of said first and second passageways exteriorly of said container being greater than the distance of said first and second passageway interiorly of said container.

* * * * *